United States Patent [19]

Morgan

[11] 4,167,434

[45] Sep. 11, 1979

[54] UNIVERSAL DRAPERY MAKING EQUIPMENT

[76] Inventor: Ronald W. Morgan, 6311 Lime Rd., Louisville, Ky. 40222

[21] Appl. No.: 871,612

[22] Filed: Jan. 23, 1978

[51] Int. Cl.[2] ..... B32B 31/00; B23D 19/00; A47F 5/12

[52] U.S. Cl. ..... 156/510; 83/471.2; 83/648; 108/7; 156/574

[58] Field of Search ..... 156/510, 577, 574; 108/6, 7; 83/471.2, 648, 614

[56] References Cited

U.S. PATENT DOCUMENTS

| | | | |
|---|---|---|---|
| 1,996,387 | 4/1935 | Owen | 225/96.5 |
| 2,187,312 | 1/1940 | Goodlake | 108/7 |
| 2,593,364 | 4/1952 | Thompson | 108/7 |
| 3,137,089 | 6/1964 | Smith | 108/6 |

*Primary Examiner*—Douglas J. Drummond
*Attorney, Agent, or Firm*—Price and Caslin

[57] ABSTRACT

A universal drapery making machine having a horizontal working table for handling a drapery panel that has its bottom edge and its two side edges hemmed at prior stations, and an unfinished top edge of the drapery. The operator is able to attach the bottom edge of the drapery panel face down to a transverse bar that is movably supported over the top planar surface of the table. Motive means moves the bar toward the rear edge of the table, and the panel is then measured to size, and the top edge of the drape is simultaneously cut and a stiffening tape such as buckram with its own adhesive strip is attached along the cut edge. Then this stiffened edge is manually folded over twice and stapled temporarily in place so the drapery may be removed to a later station for forming the pleats in this header. The table is pivotally supported by a transverse pivotal support means. The table is provided with motive means for raising the back edge of the table toward a vertical standing position or any tilted or slanting position therebetween. A slanting or vertical table is useful when working with loose woven, dimensionally unstable fabric such as casement fabric. In that event a different procedure would be followed. The unfinished drapery panel would be attached to the transverse bar by its bottom hemmed edge, the bar moved toward the rear of the table, the table elevated at the rear so as to suspend the drapery panel by its own weight to obtain a more accurate measurement before cutting and applying the buckram.

18 Claims, 10 Drawing Figures

UNIVERSAL DRAPERY MAKING EQUIPMENT

BACKGROUND OF THE INVENTION

1. Field of the Invention

This invention relates to mechanized equipment for assisting in making draperies, and particularly to a universal working table that is used mostly in a horizontal position, but may be raised into an inclined or vertical position so the drapery material may be suspended by its own weight in its use position for processing and/or inspection.

2. Description of the Prior Art

Fixed horizontal working tables for making draperies have been known for many years. Large amounts of time are spent in laying the drapery panels flat on large tables, called tabling, so as to make accurate measurements from the top edge of the drapery, and to pin the hem in as the operator works from one side to the other. Accuracy is essential to obtaining a satisfied customer. The drapery must be pleated uniformly, it must hang straight, and it must be hemmed straight to fit the room; whether to the window sill or to the floor.

There are also mechanized horizontal work tables.

The Tuskos U.S. Pat. No. 3,439,438 shows a vertical frame with a vertically movable trolley on which a drapery panel may be suspended from its pleated header. The trolley is raised so when a proper height is obtained, a crease may be ironed across the lower edge of the drapery, then the panel is trimmed and hemmed which defines the bottom edge of the drapery. The drapery material hangs of its own weight, as in its use position, so that delicate, dimensionally unstable material such as casement fabric and the like, will be subject to actual stress and strain conditions. This vertical frame has some advantages over the horizontal table, in working with some dimensionally unstable fabrics, but also some shortcomings. It is easier for the operator to work on a horizontal table.

The present invention of a universal drapery making table derives the advantages of both the horizontal table and the vertical frame.

The Tuskos U.S. Pat. No. 3,738,007 shows another vertical frame assembly with a vertically movable trolley on which a drapery panel may be suspended by its pleated header. In this patent, cutting means are combined with marker means on a carriage that is capable of horizontal travel for simultaneously trimming the bottom edge of the drapery panel while the folding line is being marked. The marker means may be viewed under ultraviolet light.

The patent of R. W. Morgan and D. L. Witherspoon, U.S. Pat. No. 3,996,083 shows another vertical frame assembly with a vertically movable trolley on which an inverted drapery panel is suspended by its bottom hem edge. In this patent, a reinforcing or stiffening tape such as buckram is applied directly to the unfinished top edge of the inverted drapery panel without the necessity of marking, or stitching. The buckram is adhesively secured to the drapery material. Then the buckram edge is folded over itself to form a reinforcing header that is secured by stapling, adhesively or by stitching.

SUMMARY OF THE INVENTION

The present invention provides a mechanized drapery making table that has a pivotal support means so the table may be fixed in alternate positions between a generally horizontal position and a generally vertical position. A first motive means is capable of raising and lowering the table about it's pivotal support means. A transverse bar is movably supported with respect to the planar surface of the table, and the bar extends from side to side of the table. A second motive means is capable of moving the transverse bar between the front edge of the table and a second position toward the rear edge of the table. A drapery panel is capable of being attached to the transverse bar so as to be movable therewith. Finishing means are available along the front edge of the table for finishing the adjacent edge of the drapery panel.

BRIEF DESCRIPTION OF THE DRAWINGS

This invention will be better understood from the following description taken in conjunction with the accompanying drawings, and its scope will be pointed out in the appended claims.

DESCRIPTION OF THE PREFERRED EMBODIMENTS

Figure 1:
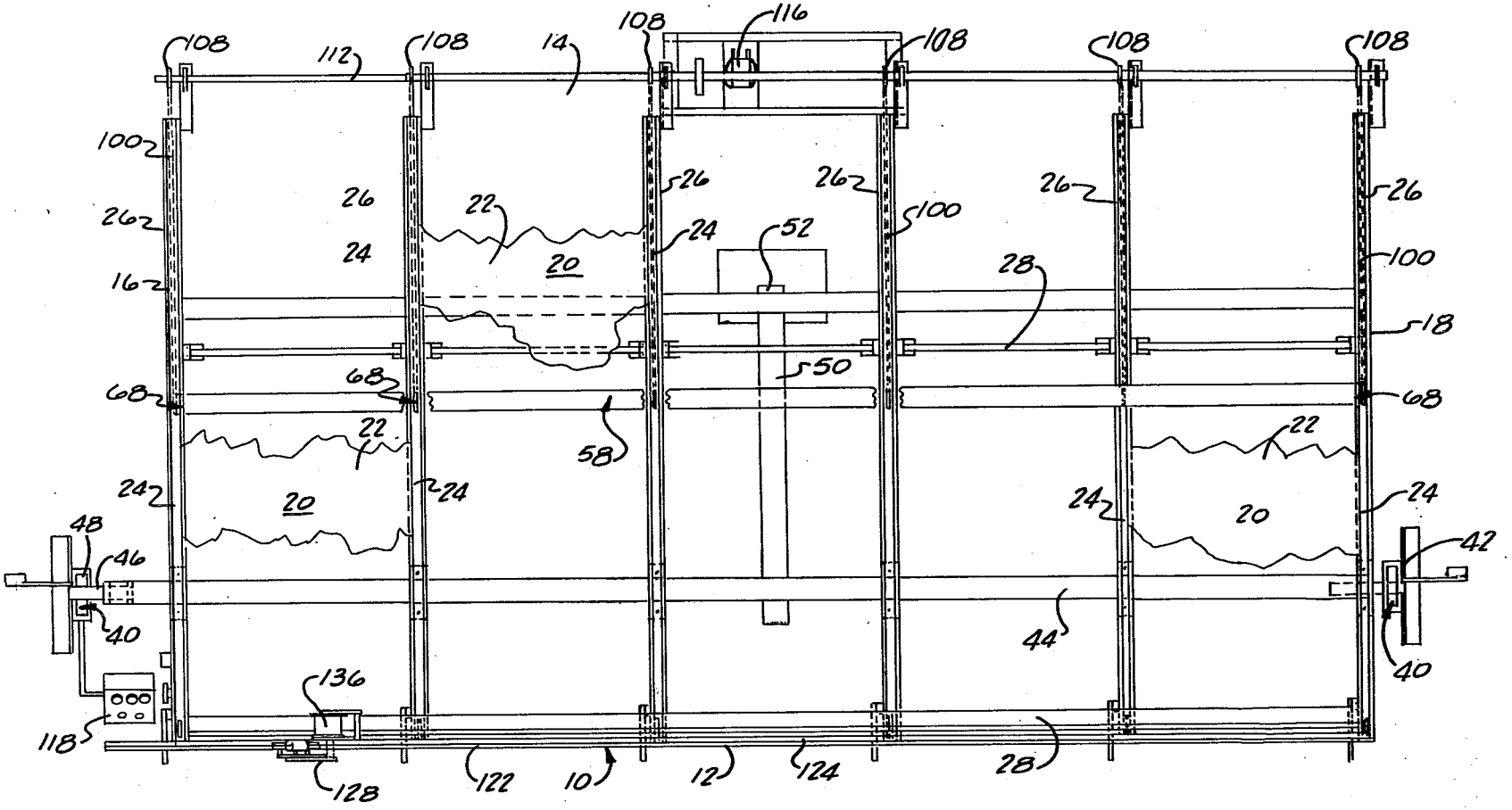
FIG. 1 is a top plan view of the universal drapery making table of the present invention shown in its horizontal position with most of the planar surface of the table removed to show the skeletal nature of the table, with the pivotal support axis of the table located near the front edge of the table, the transverse bar positioned intermediate the front and rear edge of the table, and a track-mounted carriage along the front edge of the table for simultaneously adhesively applying a buckram tape to the lower edge of the inverted drapery panel while trimming the panel to an accurate dimension.

Turning now to a description of the drawings, and in particular to the top plan view of FIG. 1, there is shown a universal, drapery making table 10, that is rather large in dimensions, on the order of 20 feet wide and 10 feet from front to back. The front edge 12 of the table is where the operator would stand and work and perform the finishing operations on the drapery panel (not shown). The rear edge 14 of the table is generally parallel with the front edge. The table 10 also has two side edges 16 and 18. The table 10 has a table top or planar surface 20 that is formed by a plurality of table panels 22, that in the illustrated embodiment are five in number. The panels 22 are each spaced apart to form an elongated slot 24 that separates each panel and extends from the front edge 12 to the rear edge 14. Such an elongated slot 24 also extends along each edge 16 and 18 of the table.

Figure 6:
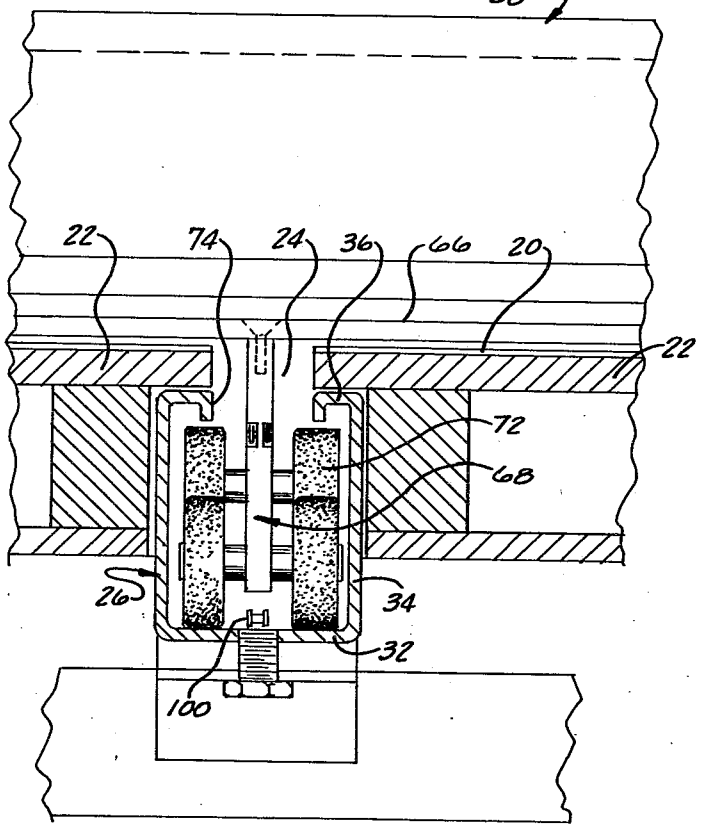
FIG. 6 is a right side view of FIG. 5 showing the master bar and its supporting trolley riding in the slotted box rail.

The main superstructure of the table comprises a series of front-to-back box beams 26 which are joined together by a series of transverse joists 28. A cross-sectional view of a box-beam 26 is shown in FIG. 6. The box-beam 26 has a horizontal bottom wall 32, spaced vertical side walls 34, 34 and a slotted top wall 36. The slot in the top wall 36 coincides with the elongated slot 24 that separates the table panels 22. Thus in the illustrated embodiment of FIG. 1 there are six box-beams 26, and five table panels 22. Of course, other tables could be devised which are smaller or larger in size without departing from the scope of this invention.

A distinctive feature of the present invention is the transverse pivotal support means 40 for the table that is located adjacent the front edge 12 of the table 10. This pivotal support means 40 permits the table to be fixed in any position between the horizontal position of FIG. 1 to a generally vertical position which is shown in dotted lines in FIG. 4.

The pivotal support means 40 comprises a vertical pillar 42 at each side 16 and 18 of the table, a heavy, transverse, box-beam 44 extending across the underside of the table with a stub shaft 46 at each end of the beam 44. A bearing block 48 is mounted on each pillar 42 for receiving the stub shaft 46.

Figure 2:
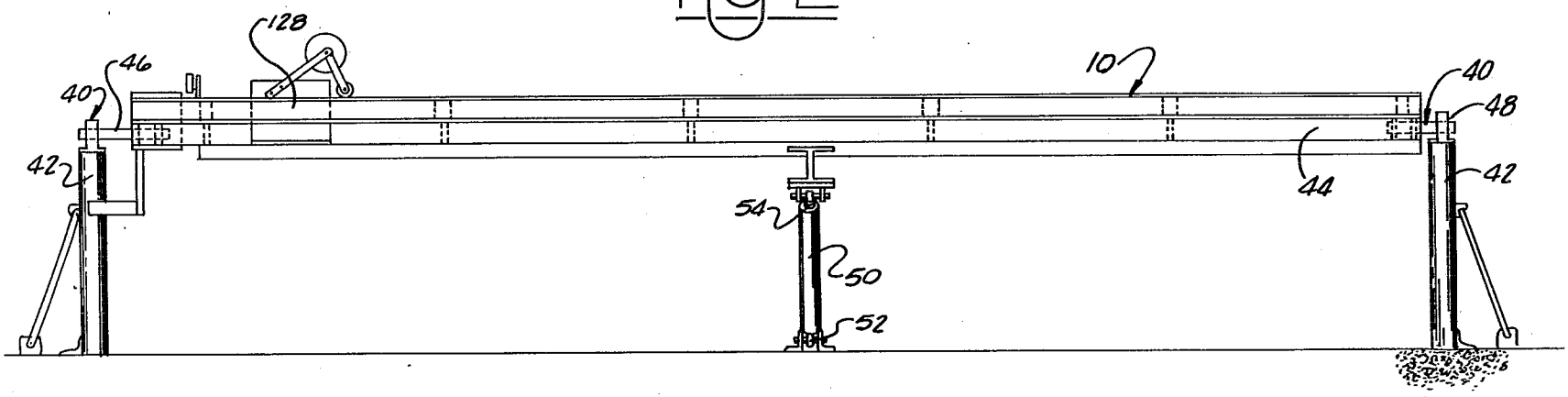
FIG. 2 is a front elevational view of the horizontal table of FIG. 1 showing the pivotal support means at each side of the table, a hydraulic or pneumatic cylinder at the center of the table for raising and lowering the table, as well as the track extending across the front edge of the table, and a carriage riding on the track, with a roll of buckram tape and electric scissors mounted on the carriage.
Figure 3:
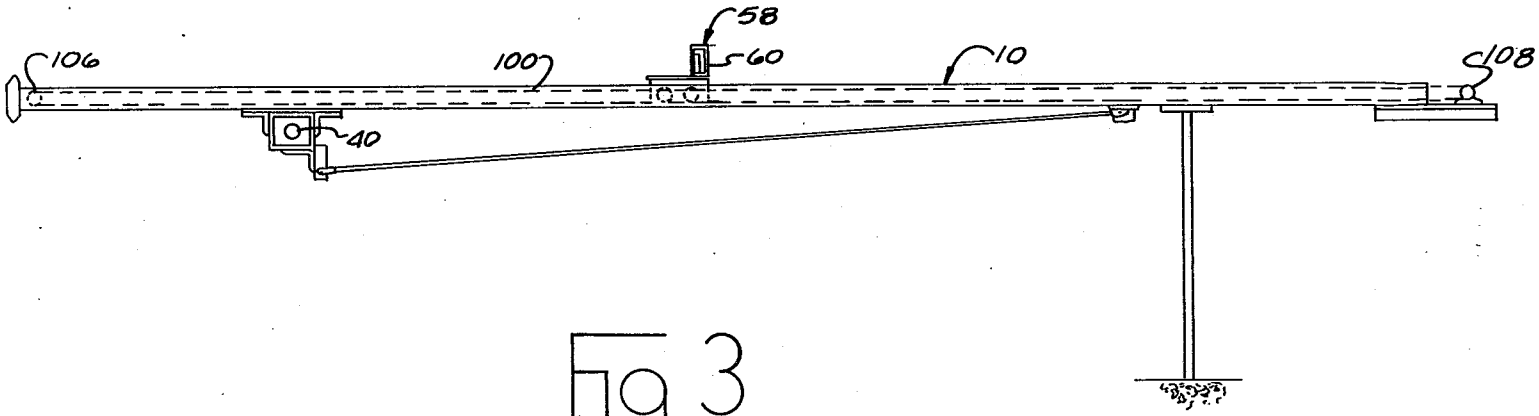
FIG. 3 is a fragmentary side elevational view of the table in its horizontal position showing the transverse bar in side view with the chain drive for moving the bar across the table.
Figure 4:
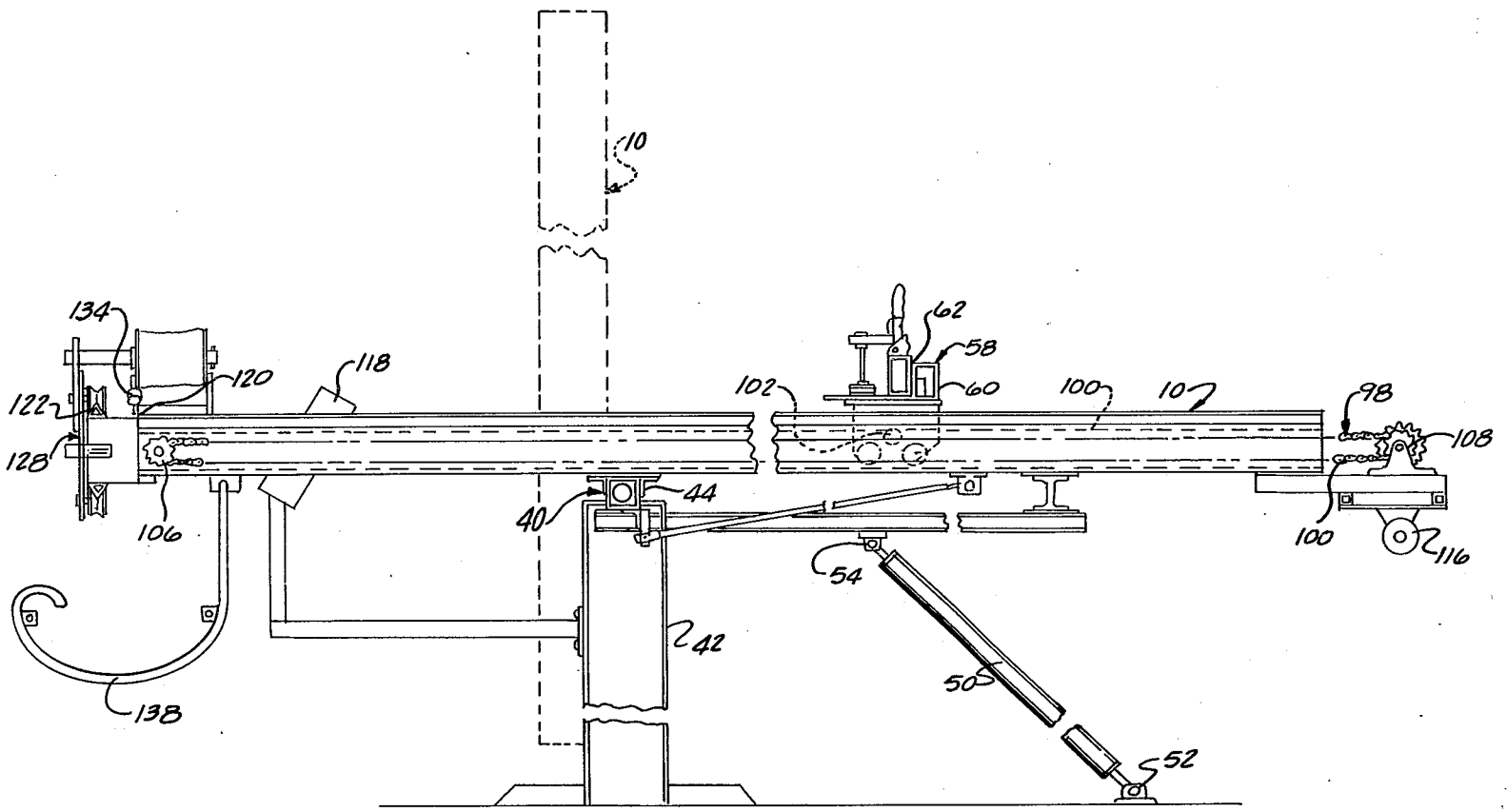
FIG. 4 is a full side elevational view of the table in its horizontal position of FIG. 2 showing a processing bar that is adapted for clamping the bottom hem edge of a drapery panel, where the processing bar is carried and held in place on the transverse bar by an electromagnet that is built into the transverse bar, as well as a catcher basket positioned beneath the front edge of the table for holding the drapery material off the floor at times, and to catch drapery cuttings.

The motive means for raising and lowering the table 10 is a fluid pressure cylinder means 50, as is best seen in FIGS. 2 and 4. One end of the cylinder 50 is pivotally supported to the floor as at 52, while the opposite end is pivoted to the table 10 as at 54.

Figure 5:
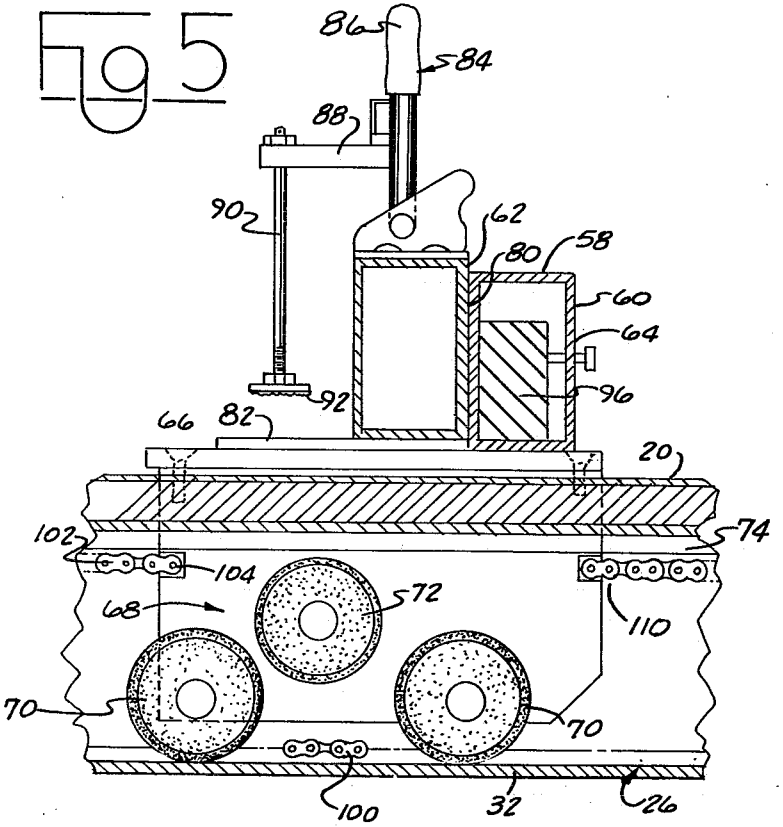
FIG. 5 is an enlarged fragmentary side elevational view partly in cross-section of the master bar supported from below by a trolley riding within a rail beneath the table and moved by a chain drive. Notice the master bar is raised above the planar surface of the table to be out of frictional contact therewith. The processing bar is shown in midair to best show its nature independent of the cooperating master bar.
Figure 7:
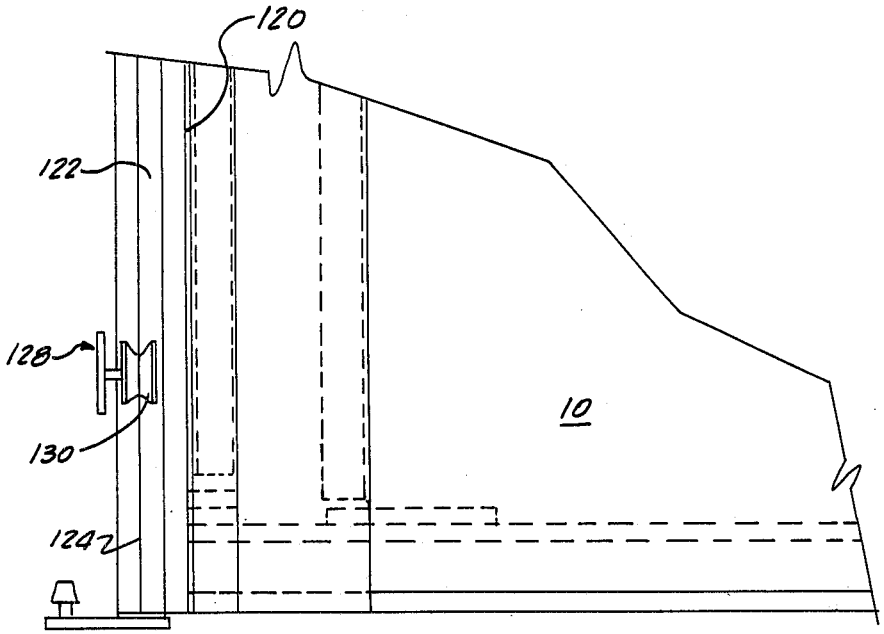
FIG. 7 is a fragmentary plan view of the horizontal table of FIG. 1 on an enlarged scale showing the nature of the rail for supporting the buckram tape and scissors carriage for travel across the front edge of the table.

A transverse bar 58 is movably supported with respect to the planar surface 20 of the table 10, and it extends from one side 16 to the other side 18 of the table. This transverse bar is made up of two bars; a first master bar 60 and a second separable, processing bar 62, as is best seen in FIG. 5. The master bar comprises a closed box beam 64 sitting on and fixed to a flat, base plate 66. The base plate 66 is supported in a slightly elevated position above the planar surface 20 of the table by a series of spaced trolleys 68 which travel through the series of parallel, slotted, box beams 26. Each trolley 68 has a series of four support rollers 70 and a pair of raised stabilizing rollers 72 which cooperate with the underside of the flanges 74 of the slotted top wall 36 of the box beams 26 so as to stabilize the trolleys when the table 10 is raised to a generally vertical position, as is shown in dotted lines in FIG. 4. Each trolley 68 has a vertical, center plate 76 which extends up through the slot 24 that separates the table panels 22 from each other. The height of this center plate 76 is such that the base plate 66 of the master bar 60 does not touch the planar surface 20 of the table.

Figure 9:
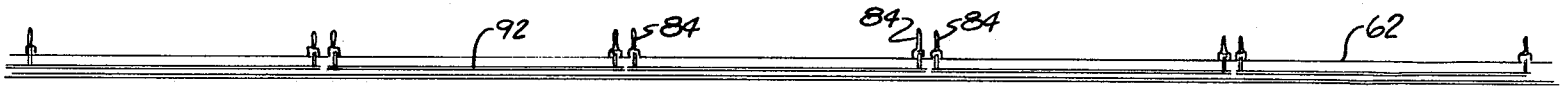
FIG. 9 is a front elevational view of the processing bar having a plurality of elongated clamping pads, each with a manual toggle clamp at each end.
Figure 10:
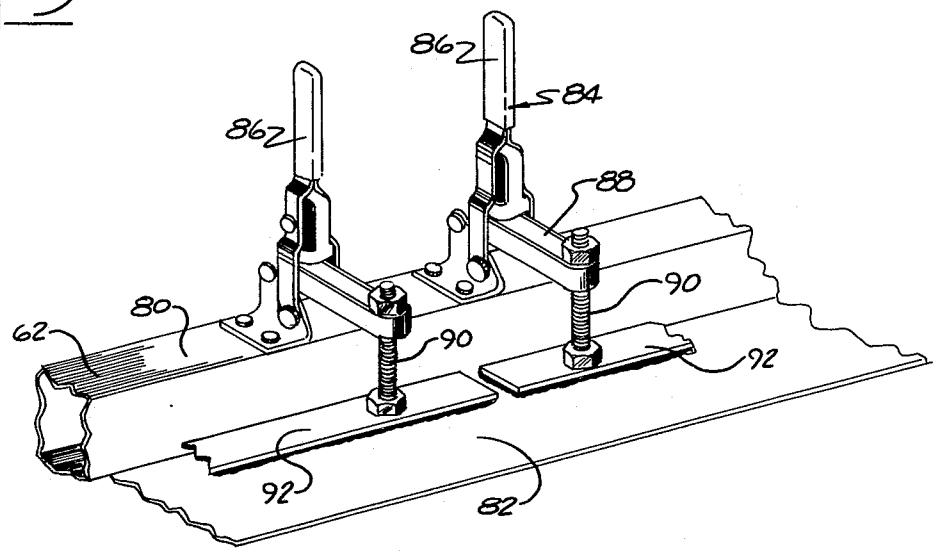
FIG. 10 is a fragmentary perspective view of a segment of the processing bar of FIG. 9 showing the nature of two adjacent toggle clamps.

The processing bar 62 also has a box beam 80 that is fixed to a base plate 82, and its length is substantially the length of the master bar 60. On top of the beam 80 is a toggle clamp 84 having a handle 86, pivoted arm 88, and a strut 90 joined to an elongated clamping pad 92, as is seen in FIGS. 5, 9 and 10. The hem or bottom edge of a drapery panel (not shown) is adapted to be positioned in the processing bar 62, on the base plate 82 and up against the beam 80, and then clamped in place by turning the toggle clamps 84 down so the pad 92 captures the drapery in place. The drapery panel would be joined to the processing bar 62 prior to bringing this bar to the table 10 and positioning it on the master bar 60. Within the beam 64 of the master bar 60 is one or more electromagnets 96, which when energized would attract the processing bar 62 to the beam 64 and lock the two bars 60 and 62 firmly together so they would move as one. See the transverse bar 58 in FIG. 4.

The transverse bar 58 is propelled with a chain drive 98 that comprises a bicycle chain 100 for each trolley 68. One end 102 of the chain is joined to the front of the trolley at 104 and the chain extends over a sprocket 106 at the front of the table and then extends to the rear of the table, beneath the trolley 68 and over a second sprocket 108, and then back to the trolley for a connection at 110. A single drive shaft 112 extends across the rear edge 14 of the table for supporting a plurality of second sprockets 108. A suitable, reversible drive motor 116 is provided for this drive shaft 112 and it is preferably capable of either a normal speed or a slow speed. This table 10 is controlled by the operator from a control console 118 that is located at a convenient height at the left front corner of the table as is best seen in FIG. 1. This control console 118 is the control center for both the hydraulic cylinder 50 for raising and lowering the table, as well as the reversible two speed drive motor 116 for moving the transverse bar 58. Since the control means for the cylinder 50 and drive motor 116 do not form part of the present invention, the control details are not being described in detail for they may be purchased from existing control suppliers.

Figure 8:
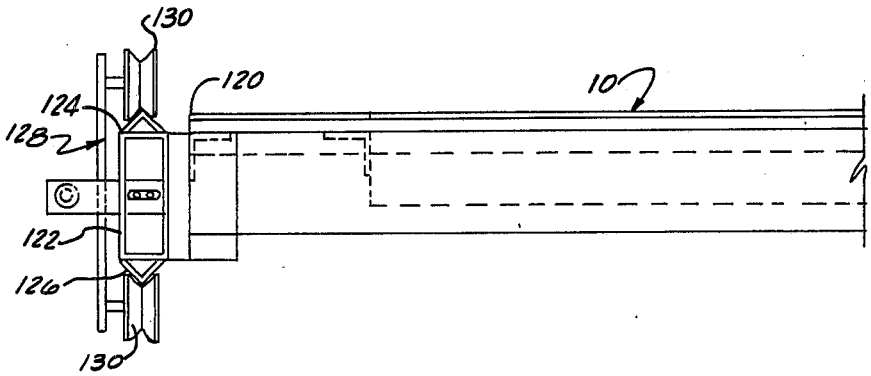
FIG. 8 is a fragmentary right side elevational view of the table of FIG. 7 showing the rail as a double edge, V-rail cooperating with top and bottom flanged rollers of the carriage.

The front edge 12 of the table is provided with finishing means for the adjacent unfinished edge of the drapery panel. The operator would drive the transverse bar until the drapery panel is spread over the table to the proper size as measured from a cutting edge 120 at the front edge 12, as is seen in FIGS. 4 and 8. Typically, a travelling measuring tape (not shown) would be connected between the cutting edge 120 of the table or some measured distance therefrom and the transverse bar 58.

An elongated track or rail 122 is positioned along the entire front face of the table. This rail has a double V edge 124 and 126, top and bottom, respectively. A carriage 128 is mounted on the rail by means of flanged rollers 130. Thus the carriage 128 rides well on the rail 122 no matter what position the table 10 may be in, whether it is horizontal or vertical, or any position therebetween.

This carriage 128 is fitted with an electric scissors 134 for trimming the edge of the drapery panel with respect to the cutting edge 120 as the carriage moves along the length of the rail 122.

The carriage 128 is also provided with a roll 136 of buckram tape or other suitable stiffening material. This tape may be supplied with an adhesive strip so the tape will be self-adherent to the trimmed edge of the drapery panel in one pass of the carriage down the rail 122. Then the operator would fold the reinforced trimmed edge over twice and temporarily staple together this header that is thus formed. A catcher basket 138 is furnished to catch the trimmings.

In the event the drapery material is dimensionally unstable as is casement fabric or the like, the table may be elevated first to a vertical or near vertical position before finishing the lower end of the inverted drapery panel. Then the drapery would be trimmed and reinforced.

Another procedure would be to use the table in its vertical position for quality control inspection after the finishing operations are complete on the drapery panel header in the horizontal position of the table.

Modifications of this invention will occur to those skilled in this art. Therefore, it is to be understood that this invention is not limited to the particular embodiments disclosed, but that it is intended to cover all modifications which are within the true spirit and scope of this invention as claimed.

What is claimed is:

1. Drapery making equipment comprising:

a. table means;

b. pivotal support means for said table means for supporting the table means in alternate fixed positions between a first generally horizontal position and a second raised position from back to front somewhere between the horizontal position and a generally vertical position;

c. first motive means for raising and lowering said table means about its pivotal support means;

d. transverse bar means movably supported with respect to the planar surface of said table means, and extending generally from one side to the other side of said table means;

e. means for attaching one edge of a drapery panel to the said transverse bar to become movable therewith;

f. second motive means for moving said transverse bar means between a first front edge position of the table means and a second position toward the rear edge of the table means;

g. finishing means for forming the lower edge of the drapery panel with respect to the front edge of the table means, said finishing means serving to measure the length of the drapery panel, to cut the panel to size as well as apply a stiffening tape means along the trimmed lower edge of the panel.

2. The invention of claim 1 wherein the said transverse bar means is spaced slightly from the planar surface of the table means so as to be generally out of frictional contact therewith.

3. The invention of claim 2 wherein the second motive means comprises a plurality of tension members joined to the transverse bar at spaced locations along the length thereof and at opposite sides of the bar for shifting the transverse bar in a uniform manner between the front edge and toward the rear edge of the table means, and motor means for operating the plurality of tension members.

4. The invention of claim 3 wherein there are at least four tension members spaced along the length of the transverse bar so as to restrict the deflection of the bar during its travel.

5. The invention of claim 1 wherein the said pivotal support means has a pivotal axis that extends transversely of the table means and is located near the front edge of the table by a distance that is generally less than the height of the pivotal axis from the supporting floor surface for this table means.

6. The invention of claim 5 wherein the transverse bar means is spaced slightly above the planar surface of the table means by the said motive means.

7. The invention of claim 1 wherein the said pivotal support means for the table means comprises a pillar located at each side of the table means, and shaft means fixed to the table means and pivotally supported from the pillars, the pivotal axis of the shaft means being located from the front edge of the table means by a distance that is less than the height of the supporting pillars.

8. The invention of claim 1 wherein the said pivotal support means is adjacent the front edge of the table means so this front edge is at a convenient working height at all positions of the table means.

9. The invention of claim 1 wherein the said finishing means for forming the other end of the drapery panel comprises a track mounted along the front edge of the table means and a carriage movable on the track, said carriage being supplied with a roll of buckram tape and cutting means whereby the tape is adapted to be applied and the drapery panel trimmed as the carriage moves over the track.

10. The invention of claim 3 wherein the said first motive means comprises a fluid pressure cylinder.

11. The invention of claim 8 wherein the said finishing means for forming the said lower end of the drapery panel comprises a track mounted along the front edge of the table means and a carriage movable on the track, said carriage being fitted with a supply of stiffening tape and cutting means whereby the tape is adapted to be applied and the drapery panel trimmed as the carriage travels over the track.

12. The invention of claim 11 wherein the transverse bar means is spaced slightly off of the planar surface of the table means.

13. The invention of claim 1 wherein the said transverse bar means comprises a first master bar that is joined with the said second motive means as well as a second removable processing bar that is furnished with clamping means for engaging one edge of the drapery panel, said master bar including releasible locking means for fixing the processing bar to the master bar.

14. The invention of claim 13 wherein the said releasible locking means of the master bar comprises electromagnetic means.

15. The invention of claim 12 wherein the said transverse bar means comprises a first master bar that is joined with the said second motive means as well as a second removable processing bar that is furnished with clamping means for engaging one edge of the drapery panel, said first master bar including releasible locking means for fixing the processing bar to the master bar.

16. The invention of claim 1 wherein the table means is movable into an inclined or generally vertical position when the drapery panel is of dimensionally unstable material whereby the panel hangs substantially of its own weight to expose the drapery panel to actual use conditions and affords the opportunity of making more accurate measurements.

17. The invention of claim 1 wherein the table means is movable into a raised position so that the drapery panel is allowed to hang of its own weight under actual use conditions for quality control inspection after the finishing operations.

18. The invention of claim 16 wherein the said finishing means for forming the said other end of the drapery panel comprises a track mounted along the front edge of the table means a carriage movable on the track, said carriage being fitted with a supply of stiffening tape and cutting means whereby the tape is adapted to be applied and the drapery panel trimmed as the carriage travels over the track.

* * * * *